US005592706A

United States Patent [19]

Pearce

[11] Patent Number: 5,592,706

[45] Date of Patent: Jan. 14, 1997

[54] CUSHIONING DEVICE FORMED FROM SEPARATE RESHAPABLE CELLS

[75] Inventor: Tony M. Pearce, Alpine, Utah

[73] Assignees: TekSource, LC, Draper, Utah; Nike, Inc.; Nike International, Ltd., both of Beaverton, Oreg.

[21] Appl. No.: 149,224

[22] Filed: Nov. 9, 1993

[51] Int. Cl.[6] ..... A47C 27/10; A61G 7/057

[52] U.S. Cl. ..... 5/654; 5/911; 5/922

[58] Field of Search ..... 5/654, 455, 449, 5/450, 451, 909, 911, 922, 464, 448; 297/180.13, 284.6, 452.41, 452.42

[56] References Cited

U.S. PATENT DOCUMENTS

| | | | |
|---|---|---|---|
| 1,228,783 | 6/1917 | Kerivan | 5/449 |
| 2,491,557 | 12/1949 | Goolsbee | 5/455 |
| 2,655,369 | 10/1953 | Musili | 5/455 |
| 2,672,183 | 3/1954 | Forsyth | 5/455 |
| 3,407,406 | 10/1968 | Werner | 2/3 |
| 3,459,179 | 8/1969 | Olesen | 5/449 |
| 3,462,778 | 8/1969 | Whitney | 5/347 |
| 3,518,786 | 7/1970 | Holt Voigt | 46/24 |
| 3,529,368 | 9/1970 | Canfield | 36/2.5 |
| 3,552,044 | 6/1971 | Wiele | 36/71 |
| 3,748,669 | 7/1973 | Warner | 5/348 WB |
| 3,748,779 | 7/1973 | Cherk et al. | 46/115 |
| 3,968,530 | 7/1976 | Dyson | 5/338 |
| 3,986,213 | 10/1976 | Lynch | 3/36 |
| 4,038,762 | 8/1977 | Swan, Jr. | 36/89 |
| 4,083,127 | 4/1978 | Hanson | 36/93 |
| 4,144,658 | 3/1979 | Swan, Jr. | 36/117 |
| 4,163,297 | 8/1979 | Neumark | 5/455 |
| 4,229,546 | 10/1980 | Swan, Jr. | 521/55 |
| 4,243,754 | 1/1981 | Swan, Jr. | 521/55 |
| 4,252,910 | 2/1981 | Schaefer | 521/145 |
| 4,255,202 | 3/1981 | Swan, Jr. | 106/122 |
| 4,292,701 | 10/1981 | Woychick | 5/422 |
| 4,467,053 | 8/1984 | Markle | 521/128 |
| 4,472,847 | 9/1984 | Gammons et al. | 5/453 |
| 4,588,229 | 5/1986 | Jay | 297/459 |
| 4,628,557 | 12/1986 | Murphy | 5/922 |
| 4,660,238 | 4/1987 | Jay | 5/431 |
| 4,698,864 | 10/1987 | Graebe | 5/654 |
| 4,709,431 | 12/1987 | Shaktman | 5/481 |
| 4,726,624 | 2/1988 | Jay | 297/459 |
| 4,728,551 | 3/1988 | Jay | 428/76 |
| 4,737,998 | 4/1988 | Johnson, Sr. | 5/422 |
| 4,761,843 | 8/1988 | Jay | 5/431 |
| 4,842,330 | 6/1989 | Jay | 297/4 |
| 4,945,588 | 9/1989 | Cassidy et al. | 5/451 |
| 4,952,190 | 8/1990 | Tarnoff et al. | 446/267 |
| 4,952,439 | 8/1990 | Hanson | 428/72 |
| 4,953,913 | 9/1990 | Graebe | 297/459 |
| 5,010,608 | 4/1991 | Barnett et al. | 5/453 |
| 5,015,313 | 5/1991 | Drew et al. | 156/87 |
| 5,018,790 | 5/1991 | Jay | 297/458 |
| 5,020,176 | 6/1991 | Dotson | 5/453 |
| 5,052,068 | 10/1991 | Graebe | 5/654 |
| 5,058,291 | 10/1991 | Hanson | 36/117 |
| 5,074,620 | 12/1991 | Jay et al. | 297/337 |
| 5,079,786 | 1/1992 | Rojas | 5/450 |
| 5,079,787 | 1/1992 | Pellman | 5/450 |
| 5,093,138 | 3/1992 | Drew et al. | 426/68 |
| 5,100,712 | 3/1992 | Drew et al. | 428/68 |
| 5,103,518 | 4/1992 | Gilroy et al. | 5/543 |

(List continued on next page.)

*Primary Examiner*—Alexander Grosz
*Attorney, Agent, or Firm*—Daniel McCarthy; Mark G. Sandbaken

[57] ABSTRACT

A cushion that includes a base and numerous bladders locatable on the base is disclosed and claimed. Each bladder contains a quantity of filler insufficient to completely fill the bladder, and each bladder has a loose or elastomeric skin to accommodate its conforming to the shape of an object to be supported by the cushion. The top surface of each bladder acts as a hammock when supporting a cushioned object, and the bladders interact with each other to accommodate protuberance and crevices of the cushioned object. Other embodiments of the invention include a cushion that is pre-shaped in a form complementary to the shape of the object to be cushioned, and a cushion that re-shapes itself to maintain supporting forces that are generally equal across the contact surface of the supported object.

4 Claims, 3 Drawing Sheets

U.S. PATENT DOCUMENTS

| | | | |
|---|---|---|---|
| 5,111,544 | 5/1992 | Graebe | 5/654 |
| 5,147,685 | 9/1992 | Hanson | 428/189 |
| 5,152,023 | 10/1992 | Graebe | 5/654 |
| 5,163,196 | 11/1992 | Graebe et al. | 5/654 |
| 5,190,504 | 3/1993 | Scatterday | 482/49 |
| 5,201,780 | 4/1993 | Dinsmoor et al. | 5/455 |
| 5,204,154 | 4/1993 | Drew et al. | 427/68 |
| 5,335,907 | 8/1994 | Spector | 273/58 H |
| 5,369,828 | 12/1994 | Graebe | 5/455 |
| 5,421,874 | 6/1995 | Pearce | 5/911 |

CUSHIONING DEVICE FORMED FROM SEPARATE RESHAPABLE CELLS

I. BACKGROUND OF THE INVENTION

A. Field of the Invention

The invention relates to the field of cushioning, particularly to equalization of pressure across the surface of a cushioned object and minimization of high pressure areas. More specifically, the invention is a plurality of individual cushioning bladders configured and arranged so that each bladder has substantial freedom of movement with respect to any protrusions on the cushioned object, and so that the bladders may interact with and influence each other to achieve even distribution of force and pressure across the cushioned object, regardless of any irregular surface or protrusions existing on the cushioned object. In various embodiments, the cushion may be uniformly shaped, pre-shaped, or periodically reshapable.

B. The Background Art

It is well known that persons who must sit or lie in a reclined position for extended periods of time experience localized tissue breakdown leading to decubitus ulcers (pressure sores), which in turn can lead to extensive hospital stays, and in severe cases, even amputation. The tissue breakdown of decubitus ulcers is caused by lack of blood circulation in localized areas. Blood circulation is slowed or prevented when pressure in the tissue caused by an external source exceeds the internal blood pressure in the capillaries and vessels of the tissue. Such excessive localized external pressure often occurs when a person sits or lies on traditional cushioning devices, which can cause higher pressures on bony prominence (e.g. hip bones) than on non-prominent areas.

Traditional cushioning devices consist of flexible foams which when deformed behave similar to springs. The more the deformation, the more force the foam applies to the deforming object in an effort to return to its original undeformed shape (i.e. the foam has "memory"). When the deforming object on a cushion is a portion of human body, the deforming force causes excessive pressure on body tissue which can lead to discomfort or to decubitus ulcers.

Supporting pressure on the tissues of sitting or lying persons cannot be eliminated, since in order for the person to be supported, the total cushioning force on all of his/her tissues must equal the weight of the person. The objective of an effective cushion is not to eliminate these supporting forces, but to distribute them as evenly as possible to eliminate peak pressures, and to distribute them over as large an area as possible to minimize average supporting pressure. In most cases, and specifically in the cases of wheelchair cushions and bed mattresses, the area of human tissue to which supporting force is applied is large enough that if the cushioning force is equalized over that entire area, the pressure on the human tissue will be less than that which causes decubitus ulcers. The pressure at which circulation is slowed to the point that tissue damage and decubitus ulcers become a substantial danger is 30 millimeters of mercury.

Optimally, a cushion should have a shape that is precisely the complementary shape of the object being cushioned so that it contacts and supports each protrusion and crevice of the cushioned object. This results in the supporting forces being applied to the cushioned object over the largest possible. To area, resulting in the lowest possible supporting pressure. To fully achieve this goal, the cushion material must not be attempting to return to some other shape (i.e. it must not have memory).

A flat foam cushion is very ineffective at achieving these goals because: (1) the cushion is not originally shaped to match the contours of the object to be rested on it, and when an object is placed on the foam cushion, the foam imperfectly re-shapes to the object's contour, not utilizing the entire surface area over which the supporting force is applied; and (2) because of its memory, the foam attempts to rebound and return to its original flat shape, applying stressful pressure to the cushioned object in direct proportion to the degree to which the foam cushion has been deformed. The prominent areas of a human body being cushioned (e.g. the area near hip bones) deform the foam from its original flat shape more so than do other areas of the body, causing the pressure to be very high near the prominent areas in comparison with the non-prominent areas. These pressure peaks can cause discomfort and can cause tissue damage that leads to decubitus ulcers.

Pre-shaping the foam (e.g., cutting it to match a particular body contour) is only marginally effective at achieving equalized pressure distribution because the cutting process is inherently inaccurate, precise placement of the object or person on the contoured foam cushion is difficult, movement of the object or person on the cushion defeats the benefits of the contour, and the memory of even pre-shaped finite-thickness foam causes undue pressure on body tissue and can lead to tissue damage.

In addition to foam cushions, the prior art includes various fluid-filled cushions. Most prior art fluid-filled cushions have been more effective than foam cushions in equalizing supporting pressures. The prior art fluid-filled cushions consist of large single bladders (compartmentalized or single-compartment) filled with a fluid (some type of liquid or gas/air). Some of the prior art bladders are placed atop a shaped tray, the edges of which prevent the fluid from flowing laterally. Fluids are more effective than foam in providing non-damaging cushioning to human tissue because they have relatively Little shape memory, and if properly containerized, they will flow to generally match the contour of the body being cushioned.

All fluid cushions (including the invented cushion described herein) depend on "hammocking" to suspend the person on the cushion fluid within the cushion bladder(s). Hammocking is defined as the tensioning of the top surface of a bladder material by limiting its edge (i.e. side) movements when a force is applied to the top surface of the bladder in the general direction of the fluid beneath. This is similar to the mechanics of a well-known sleeping hammock which has its ends restricted from moving by being tied between two trees, thereby tensioning the hammock to support a person lying on the hammock. If cushions provided no hammocking, the person sitting or lying on the cushion would sink through the fluid in the bladder(s) and bottom out on the surface beneath the fluid-filled bladder(s). This can be proven by the principle of physics that the buoyant (upward) force on an object in a fluid is equal to the weight of the fluid displaced by the object. In order to suspend a person on a fluid cushion without hammocking, the person would have to sink deep enough into the fluid to displace his/her body weight of fluid. This cannot occur in any prior art fluid cushions or the invented cushion, all of which are limited to a few inches in thickness. Thus, the suspension of the person is not entirely from buoyancy in fluid, and is in fact mostly from hammocking of bladder material.

The objective of a fluid-filled cushion, therefore, should not be to eliminate hammocking, but to distribute the hammocking forces over as large an area of the supported object as possible and as evenly as possible. Prior art fluid cushions fail to do this. Single bladder non-segmented cushions of the prior art must stretch the bladder skin tightly (i.e. fill the cushion very full with fluid) to prevent bottoming out. Otherwise the fluid under protruding body parts would flow not just to non-protruding parts (which would in fact help equalize pressure), but also to parts of the bladder on which the person is not sitting, thus allowing the person to sink through the fluid to the surface beneath the cushion. This prior art practice of filling the cushion very full creates a single hammock from edge to edge of the cushion. A single hammock has high peak pressures because it suspends protruding body parts on the bladder material first, placing additional pressure on those protruding parts when the full weight of the person deforms the resistive bladder further, and it does not fully conform to the contours and crevices of the cushioned body. Thus, a single bladder cushion has some characteristics and negative attributes similar to foam.

In an attempt to solve these problems, recent prior art cushioning devices have used a segmented bladder to prevent fluid flow from one segment or cell to another. For example, some prior art bladders are quadrilaterally segmented by sealing the top surface of the bladder to its bottom surface to create four segmented cells in such a way as to prevent fluid from flowing from the forward half to the back half, or from the left half to the right half, or etc. This creates four hammocks, and so distributes load better than a single hammock.

Unfortunately, the prior art methods of segmenting a single large bladder (i.e., selectively sealing the top bladder surface to the bottom bladder surface) created a situation in which the bladder surfaces, and hence also the fluid, were movement-restricted by these segmenting seals and could not fully conform to the irregular surface of the user's body. This reduced the total surface area of human tissue onto which the cushioning force was applied, thus raising the average pressure and increasing the danger of tissue damage. Also, the small number of bladder segments used by the prior art created some peak pressure areas. Additionally, because this cushion design prevented fluid from flowing from one segment or cell of the cushion to another, pressure equalization among cells was not achieved and the danger of decubitus ulcers from high pressure spots was not eliminated.

II. SUMMARY OF THE INVENTION

It is an object of the invention to provide a cushion that substantially equalizes pressure over the entire contact area of the object being cushioned. This is achieved by providing a cushion that has a plurality of separate bladders each containing a quantity of fluid. The bladders each have a hammocking function to distribute pressure evenly across a supported load.

It is an object of the invention to provide a cushion that eliminates or minimizes peak pressures on the cushioned object. The hammocking function of the bladders coupled with their interactive nature (i.e. a bladder supporting a protuberance will exert pressure on bladders adjacent to it to reduce peak pressures, effectively resulting in the entire group of bladders acting as a single interactive fluid reservoir) greatly alleviates peak pressure problems.

It is an object of the invention to provide a cushion that shapes itself to completely complement the shape of the cushioned object. The use of bladders only partly filled with a fluid accommodates flow and shaping of the bladders and the cushion to conform to any irregular shape.

It is an object of the invention to provide a cushion that exerts pressure on the cushioned object at a level lower than would cause decubitus ulcers. By equalizing pressure across the entire body surface supported by the cushion and thus reducing peak pressures, and by the cushion flowing to completely complement the shape of the cushioned object, and thus reducing average pressure, decubitus ulcers will be avoided and comfort will be increased.

It is an object of the invention to provide a cushion that has little or no shape memory. By using a low-memory flowable fluid filler in the bladders of the invented cushion in conjunction with a loose-skinned flexible bladder material, a cushion without the problems of memory materials such as traditional foam is achieved.

It is an object of the invention to provide a cushion that is pre-shaped to complement the shape of the object to be cushioned. Bladder sizes, fill levels and arrangement may be chosen to pre-shape the cushion to conform to a desired contour or shape.

It is an object of the invention to provide a cushion that is automatically re-shapable to automatically conform to a body shape or provide other therapeutic effects. By providing a cushion that uses pneumatic bladders within fluid-filled bladders, the volume of the pneumatic bladders being computer controlled, the cushion can quickly re-shape to accommodate any body contour or shape or it can be programmed to provide some type of alternating support for therapy.

It is an object of the invention to provide a cushion that has a large number of independent hammocks on a fluid-filled cushion. The preferred embodiment of the invention for a wheelchair cushion uses 64 bladders across which load is spread, compared to a maximum of four segments in prior art wheelchair cushions.

It is an object of the invention to provide a cushion that uses bladders that have a large amount of freedom of movement in order to conform to irregular body surfaces. The bladders used are attached to a base at only one point and each bladder is loose-skinned and/or elastomeric and only partly filled with fluid, so the bladders readily conform to any shape.

III. BRIEF DESCRIPTION OF THE DRAWINGS

IV. DETAILED DESCRIPTION OF THE PREFERRED EMBODIMENTS

The invented device comprises a large number of individual cushioning bladders or cells (as opposed to a prior art segmented single bladder). Each bladder forms an individual cushioning hammock with substantial freedom of movement to conform to the shape of any protruding body parts. The bladders interact with each other in a way that ensures the even distribution of supporting forces over the entire body contact surface, even across surface irregularities such as protuberances and crevices.

A. Uniformly Shaped Cushion

Figure 1:
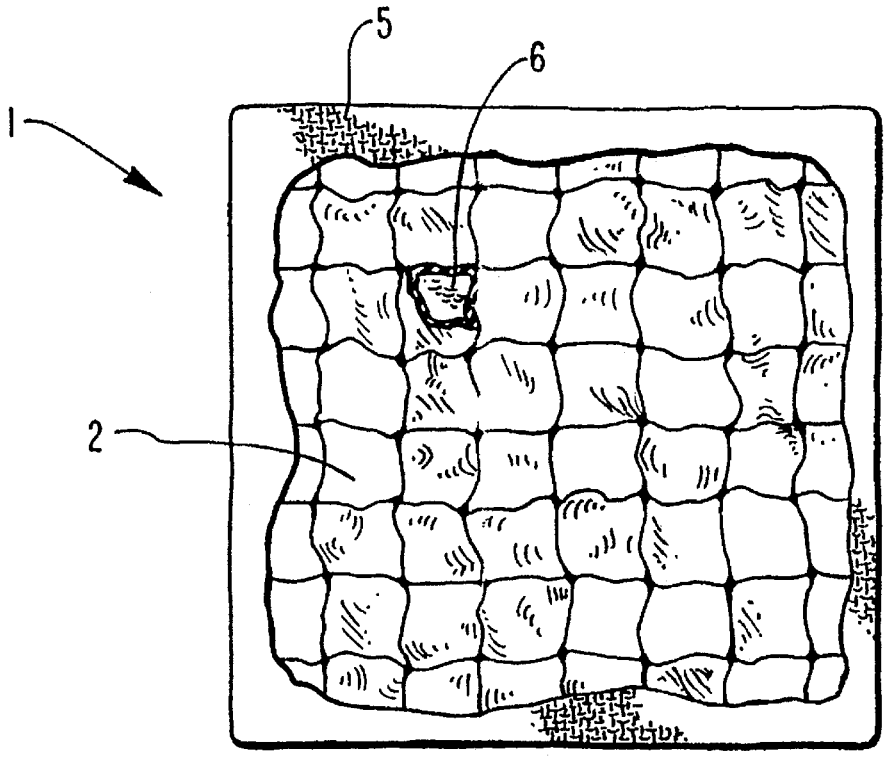
FIG. 1 depicts a top view of a uniformly shaped cushion of the invention.
Figure 2:
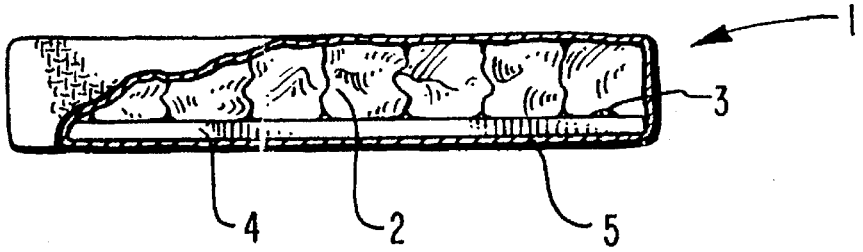
FIG. 2 depicts a side view of a uniformly shaped cushion of the invention.
Figure 3:
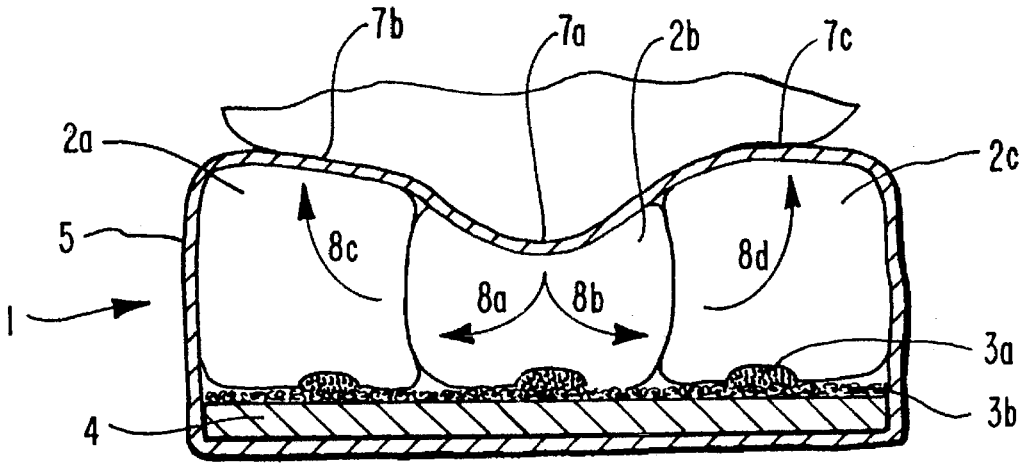
FIG. 3 depicts three bladders of a uniformly shaped cushion accommodating a protruding body part of the cushioned object.

One preferred embodiment of the invention is the uniformly shaped wheelchair cushion depicted in FIGS. 1, 2 and 3. The cushion 1 is sixteen inches long, sixteen inches wide and three inches thick. This size was chosen to provide an ample seating area for an average person. This cushion 1 comprises sixty-four bladders 2 arranged in an 8×8 array. This number and arrangement of bladders was chosen to provide individual supporting hammocks in sufficient number to efficiently spread supporting forces over the contact surface of a seated person. Each bladder 2 contains a quantity of fluid 6 and is attached to a sixteen inch by sixteen inch base 4 with hook and loop attachment means 3. Each bladder has a hook portion 3*a* in the shape of a circular patch 0.75 inch in diameter adhered to its bottom. The loop portion 3*b* of the attachment means covers the entire surface of the rigid base 4 to which the bladders are attached. Thus, each bladder 2 can be attached to any location on the rigid base 4, and can be removed and reattached at any location at will. Additionally, each bladder 2 is attached to the base 4 by only a small portion of its total surface area, permitting it to move freely to accommodate the shape of a supported body. The entire array of bladders 2 attached to the base 4 is placed inside an elastomeric fabric cover 5 for protection. An elastomeric material is preferred for the top surface of the cover 5 because it will more readily accommodate deformation and movement of the bladders 2 as they conform to a user's body shape.

In the preferred embodiment, the volumetric capacity of each bladder 2 is 300% larger than the two inch by two inch by three inch space on the base 4 allotted to each bladder 2. In other embodiments of the invention, the volumetric capacity of each bladder 2 ranges from about 105% to about 1000% of the space allotted to it on the base 4. The amount of fluid 6 contained by each bladder 2 in the preferred embodiment is only 12 cubic inches, the amount of fluid required to fill the two inch by two inch by three inch space on the base 4 allotted to each bladder 2; if completely filled, each bladder 2 would hold 36 cubic inches, so in the preferred embodiment, each bladder is only about 33% full. In other embodiments of the invention, the bladders 2 contain from 10% to 85% of their total volumetric fluid capacity when a non-elastomeric bladder material is used. If an elastomeric bladder material is used, the bladders 2 may contain from 10% to 95% of their total volumetric fluid capacity and still provide the required hammocking for proper load distribution. No other fluid (such as air) is permitted into the bladders 2 in the preferred embodiment, so a substantial amount of the capacity of each bladder 2 (about two thirds of the capacity) is not utilized. This results in each bladder 2 having a considerable amount of loose covering or skin, accommodating the bladder deformation and movement needed to equalize pressure against a cushioned object and to conform to irregular surfaces.

As shown in the FIG. 3, when a body sits or lies on the cushion 1, the protruding body part 7*a* (such as the ischia portion of the hips when the person is sitting, or the hips, shoulders, knees, and ankles when the person is lying on his side) will depress the bladders 2*b* beneath the protruding part 7*a* more than it will depress the bladders 2*a* and 2*c* beneath the non-protruding parts 7*b* and 7*c*. The equalization of hammocking forces of the multiple separate bladders is best shown in FIG. 3. The bladders depressed to a greater extent such as bladder 2*b* will deform to exert pressure (such as the lateral pressure shown with arrows 8*a* and 8*b*) on the bladders 2*a* and 2*c* next to them. The pressure from bladder 2*b* in turn deforms bladders 2*a* and 2*c*, causing them to increase in height and put pressure on non-protruding parts 7*b* and 7*c* as depicted by arrows 8*c* and 8*d*. In this manner, the plurality of bladders 2 acts to equalize the pressure on all body parts by adjusting each of the sixty-four individual hammocks (i.e. the top surface of each bladder) formed by the bladders 2 to match the shape of a body being cushioned and hence to provide equalized supporting pressure across the entire cushion/body interface.

B. Pre-Shaped Cushion

Figure 4:
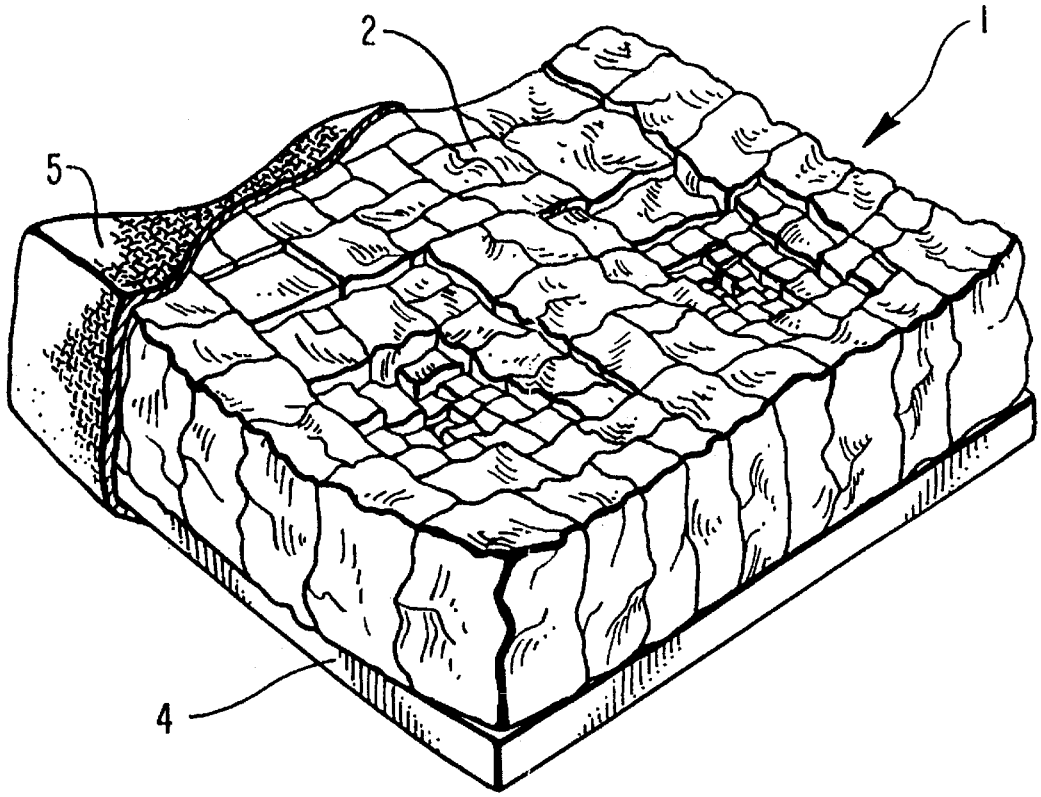
FIG. 4 depicts a pre-shaped cushion of the invention.

Another preferred embodiment of the invention exhibits even better performance in conforming to irregular body shapes than the uniformly shaped cushion described above, thus further reducing the likelihood of high average or peak pressures on the cushioned body. The preferred embodiments of the invention comprise a plurality of bladders 2, each bladder 2 being removable and reattachable to the base 4 at will, and each bladder 2 containing a quantity of fluid 6 but not being filled to capacity. A cushion 1 may be constructed of various bladders 2 of various shapes and sizes, some filled to a greater percentage of their volumetric capacity than others, and the bladders 2 arranged with varied spacing on a base 4 to accommodate a particular body shape or contour, yielding a pre-shaped cushion. Alternatively or in conjunction with such an arrangement, the dimensions and volumetric capacity of the bladders 2 could be varied as well. By selecting from an assortment of pre-filled bladders of various sizes and filled to various percentages of their volumetric capacity, and by varying the spacing between bladder attachment points, a cushion may be constructed that conforms as much as possible to the shape of the body which is to rest thereon. FIG. 4 depicts such a cushion. Typical preferred ranges of the space allotted for bladders on a sixteen inch by sixteen inch base would be one inch wide by one inch long to six inches wide by six inches long with heights from one half inch high to five inches high.

When a cushion is constructed in the manner described above, the fluid-filled bladders have less distance to flow and move to accommodate uneven body shapes, resulting in even greater equalization of hammocking forces and even less bladder memory than a uniformly shaped cushion. Such a custom built shape is simple to build when the above-described hook and loop attachment means are utilized and can be adjusted repeatedly without limit until the fit of the cushion suits the user. Pre-shaped cushions could be ordered by physicians for patients and easily custom-fitted by physical therapists from an assortment of various bladders on hand. Although the prior art made an attempt at pre-shaped segmented cushions, the prior art simply placed the main segment atop another smaller segment to deepen the fluid in areas where the user was bottoming out on the cushion. The prior art devices did not permit full customization of cushion shape as permitted by the present invention.

When a pre-shaped cushion (such as carved or sculpted foam) was used in the prior art, the user could not move around on the cushion or the benefits of the pre-shape would be lost. In the present invention, however, the deformability and fluidity of the cushion and its bladders permits some freedom of movement of the user on the cushion. In particular, turning and twisting movements of the user on the cushion are readily accommodated because of the loose bladder skin and because the bladders are attached to the base at a single attachment point that comprises only a small fraction of the total surface area. The freedom to twist or turn on the cushion with other movement on the cushion being restricted is highly desired in some cases. For example, a therapist building a wheelchair cushion for a paraplegic will design a contour into the cushion that will keep the patient's paralyzed legs in place for convenience, safety, and proper alignment with the spine, and that will keep the patient from sliding forward on the cushion. The present invented cushion can be designed in that manner, yet still permit some twisting and turning on the cushion without the need to lift the user from the surface of the cushion.

C. Periodically Re-Shaped Cushion

In another preferred embodiment of the invention, the advantages of custom shaping (such as higher equalization of pressure over the largest possible surface area due to the bladders deforming less while conforming to irregular shapes) are realized without the disadvantages of pre-shaping (such as the user having to stay in nearly the same location on the cushion). In the preferred embodiment of the periodically re-shaped cushion, bladders of uniform size and fill levels are arranged on a base to form a cushion and then enlarged or reduced in size to precisely match the user's contour after the user is sitting or lying on the cushion. The enlargement and reduction of bladders is accomplished by a system that changes the effective fluid fill level of each bladder to match the irregular shape of the body, and continues to change the individual bladder fill levels as the body moves around on the cushion to keep the cushion constantly shaped complimentary to the user's body.

Figure 5:
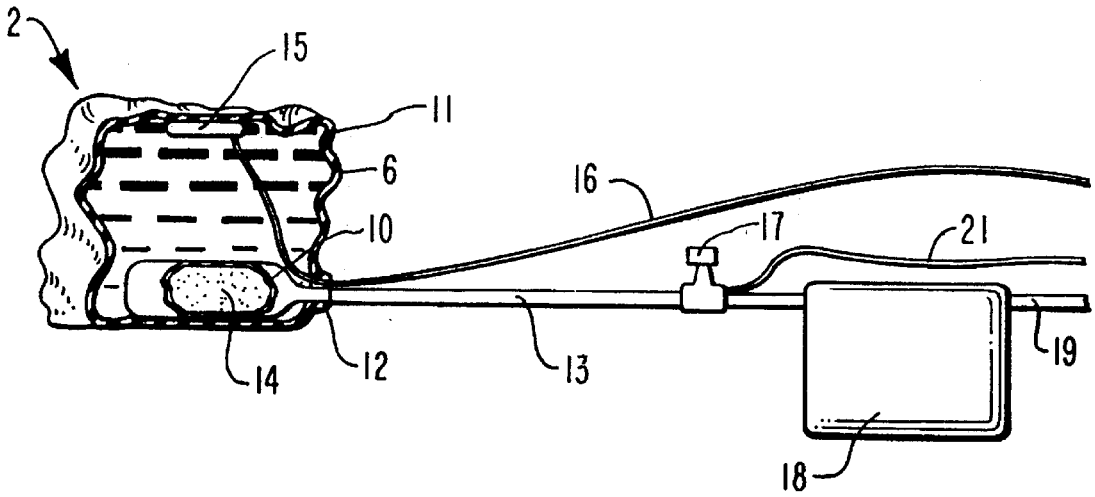
FIG. 5 depicts the components of a single bladder of a periodically re-shaped cushion of the invention.

FIG. 5 depicts the components of a single bladder of a periodically re-shaped cushion. As shown, the bladder 2 comprises an inner bladder 10 within an outer bladder 11. The outer bladder 11 also contains a quantity of fluid 6. The inner bladder 10 is inflatable with a gas 14 (such as air or any other suitable gas) through pneumatic hose 13. Where the hose 13 exits the outer bladder 11, a fluid-tight seal 12 (such as any seal known in the prior art) is used. Also located within or upon the outer bladder 11 is a pressure sensor 15 that has a lead 16 to a control unit (shown in FIG. 6).

Figure 6:
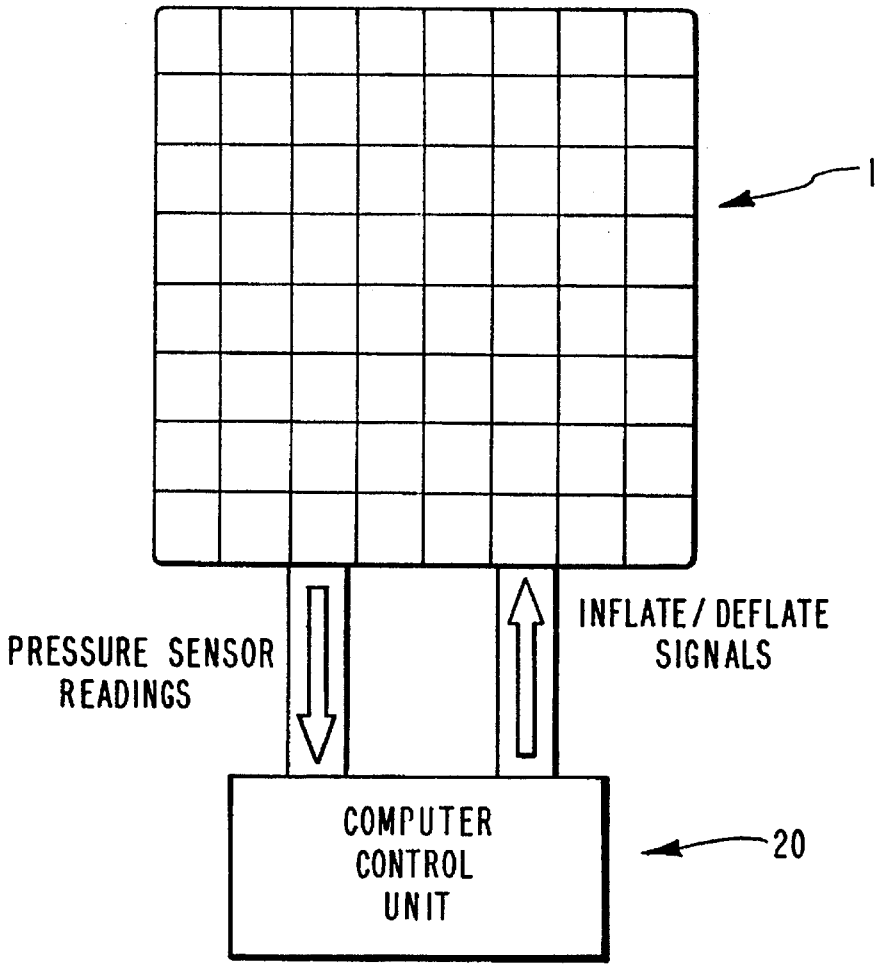
FIG. 6 depicts a functional schematic of computer control of the periodically re-shaped contour of the invention.

FIG. 6 depicts a functional schematic which illustrates computer control of the periodically re-shaped cushion. As depicted, the computer control unit 20 repetitively reads the pressure sensor data from each pressure sensor 15 of each bladder 2 via wire leads 16. This informs the computer control unit 20 of the current pressure within each bladder 2. The computer control unit 20 then determines whether more or less pressure is desirable. More pressure would be desirable in bladders adjacent to or near the bladders with the highest pressure sensor readings in order to reduce the pressure of those highest pressure bladders. Less pressure would be desired in the highest pressure bladders, as this represents the highest potential for creating pressure sores. The computer control unit 20 then sends signals to the bleed valves 17 and pressure source 18 (via wire leads 21 and 19 respectively) to either inflate or deflate each inner bladder 10 of the entire cushion 1 to achieve pressure equalization across the cushion/body interface.

The bleed valve 17 is a computer-controlled valve assembly that may be used to selectively bleed each inner bladder 10 of its gas 14 until the desired pressure within the bladder 2 is achieved by reducing the volume of the inner bladders 10 and thus reducing the overall volume within their surrounding outer bladders 11, thus reducing the pressure of the bladder 2 as a whole. The computer control unit 20 conversely inflates those inner bladders 10 which need more pressure using source 18, thus causing the inner bladders 10 to expand, thus increasing the overall volume within their outer bladders 11 and consequently increasing the pressure of that bladder assembly 2. The computer control unit 20 intermittently performs this inflation/deflation function to equalize pressure and minimize peak pressures across the cushion 1 either at set time intervals or when any single bladder has exceeded a desired pressure limit.

The periodically re-shaped cushion provides the same advantages of fit, pressure equalization and peak pressure minimization provided by the pre-shaped cushion, but with cushion form and contour even more accurately chosen and maintained. Additionally, the periodically re-shaped cushion permits the user to relocate his position on the cushion without loss of fit because the computer control unit 20 will almost instantly adjust bladder pressure to shape the cushion and equalize pressure. This is particularly important for bed cushions (such as mattresses or mattress overlays), wherein the user will lie on different locations or in different bodily orientations at different times, making pre-shaping impractical.

The computer control unit 20 may also be programmed for other modes of operation. For example, it could be programmed to systematically inflate the bladders on one side of a bed cushion for a period of time, deflate them to a lower pressure level and then inflate the bladders on the other side of the cushion. This would have an effect similar to occasionally turning the user, a function that nurses typically perform for immobile persons.

As another example, the computer control unit 20 may be programmed to alternate high and low pressures in the various bladders to stimulate circulation. Intermittent very low pressures would be used to ensure at least occasional blood flow through all tissue. In one embodiment, every other bladder would be at high pressure, and the bladders between would be at low pressure, then they would reverse. Alternatively, the inflation/deflation pattern, pressure and rate of the various bladders, could be custom designed by a physician, a physical therapist or the user for other therapeutic effects or automated gentle massage therapy.

D. Preferred Materials and Components of Construction

The preferred bladder material is made of any material that is pliable, durable enough to resist tearing or puncturing during use, and fluid-impermeable. It is also desirable, but not necessary, for the bladder material to have some elasticity to accommodate deformation of the bladders under stress. In most applications, a thin film is a desirable bladder material not only for the flexibility provided, but for light weight. For all three embodiments discussed above, a 0.010 to 0.020 inch thick polyurethane film is preferred. Any other pliable, tough plastic or rubber film is acceptable, such as latex rubber or synthetic elastomer.

The preferred fluid filler used in the bladders should flow under slight pressure, shear easily, and not have shape memory. Other desirable features include light weight and shape retention after pressure removal. The preferred fluid-like material is a composite microsphere and lubricant mixture known as "FLOAM", available from Genesis Composites, Salt Lake City, Utah, which has all of the above characteristics and is the subject of U.S. patent application No. 08/081,467 filed Jun. 22, 1993, now U.S. Pat. No. 5,421,874,which is hereby incorporated by reference in its entirety. FLOAM consists of microspheres lightly lubricated to facilitate their low-friction sliding and rolling contact with each other, but with a quantity of lubricant insufficient to disperse the microspheres in the lubricant. Any of a variety of fill materials would be acceptable for use in this invention, however, including water-based liquids, air or other gases, and oil-based liquids.

The attachment means used to attach the bladders to the base in the preferred embodiment is a hook and loop attachment means known in the industry as "VELCRO". In other embodiments of the invention, other means of adhering or attaching the bladders to the base, such as gluing, taping, sewing, etc., could be used.

The bleed valve used in the preferred embodiment of the periodically re-shaped cushion may be any of many types of commercially available bleed valves, preferably in an arrangement that includes one computer-controlled bleed valve for each inner bladder. The pressure source used in the preferred embodiment of the periodically re-shaped cushion may be any of many types of commercially available pneumatic pumps, pressure reservoirs or pressure tanks. Each bladder may have its own pressure source or a single pressure source may service all bladders. The computer control unit used in the preferred embodiment of the periodically re-shaped cushion may be a simple real-time control implementation of many types of commercially available computer control units, or a specialized computer control unit could be designed and manufactured especially for this application.

The dimensions and shape of the cushion may be varied from what is described above, and the cushion need not be sixteen inch by sixteen inch square as described above. The base to which the bladders are attached or on which they are set without attachment may be rigid, semi-flexible or even flexible as long as it is able to withstand the weight of the user without extreme deformation. Some materials which are suitable for a base include plywood, fiberglass or other composites, a standard bed mattress, rigid foam, semi-rigid foam, flexible foam, a filled water bed mattress, and others.

The bladders used in the invention do not need to be detachable and reattachable to the base (although that is desirable), but can be permanently affixed to the base, or can be set on the base without being attached thereto, instead being held loosely in place by a cover or otherwise. It is important that the sides and top of the bladders be free to move to achieve the objects of the invention, but the bladder sides may be attached to their adjacent bladder sides (such as by using hook and loop attachment means). Affixing bladders to each other may be done if the shape of the bladders is such that despite being secured to the rigid base they have a tendency for their sides to slip one atop another. The shape of the fully expanded bladder is arbitrary, and should optimally be such that when the bladder is partially filled with fluid and installed with other bladders on the cushion, the wrinkles in the loose bladder cover or skin are generally uniformly distributed to accommodate deformation equally well in any direction. Filling the bladders precisely 33% full with fluid filler is not necessary. Any level of filling that permits the skin or cover of the bladder to deform and flow to accommodate irregular surfaces and body protuberances would be acceptable. This may be accomplished by either using a Low percentage fill resulting in loose bladder skin, or by using an elastomeric bladder skin material, or both.

Any cover can be used to surround the cushion assembly provided that the top skin of the cover is loose enough or elastomeric enough to allow freedom of movement of the bladder skins. If a non-elastomeric cover is used, there should be Little enough friction between cover and bladder to permit teh bladder movement and deformation needed to accommodate body shape.

Alternatively, the invention may be used without a cover.

The invention may be made in many sizes as appropriate for the user and for the intended use. The top surface area of individual bladders can be of any size that accommodates deformation into the irregularities of the object being cushioned. If the top surface area of the bladder is too large, the bladder will span across the object's protrusions and exhibit peak pressures. If the top surface area of the individual bladder is too small, then the bladder will not be able to completely deform into the object's recessions and full distribution of support will not be achieved. The optimum number of bladders can be roughly calculated by dividing the top surface area of an optimally sized individual bladder into the top surface area of the overall cushion. The height of the bladders (i.e., the thickness of the cushion) must be sufficient to prevent bottoming out of the object's tallest protrusion.

In the periodically re-shaped cushion, the inner bladder can be enlarged and reduced by other methods than pumping and bleeding air as described. For example, other fluids such as liquids or inert gases may be pumped in and out of the inner bladder, or a self-expanding foam with a vacuum to shrink it may be employed to achieve the same result. Control methods other than a computer may be used to monitor pressure and adjust the effective volumes of individual bladders. For example, the pressure sensor readings may be read manually and adjustments may be made manually. Alternatively, the bladders can be manually adjusted without pressure sensor readings to visual shape or sensory feel.

The preferred embodiments (i.e. wheelchair and bed cushions) of the invention described above (i.e. a generalized cushion with a plethora of applications) are not intended to be limiting of the scope of the invention. The invention is useful in other products such as wheelchair backs, stadium seat cushions, bicycle seat cushions, automobile seat cushions, saddles, secretarial chairs, lounge chairs, lumbar supports, life jackets, footwear and others. The invention is also useful for cushioning of items other than the human body, such as fragile manufactured goods during shipping.

While the present invention has been described and illustrated in conjunction with a number of specific embodiments, those skilled in the art will appreciate that variations and modifications may be made without departing from the principles of the invention as herein illustrated, described and claimed. The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A cushioning device comprising:

(a) a base, (b) a plurality of individual bladders comprising an elastomeric material, said bladders being attachable to and detachable from said base, (c) a filler within each of said bladders, and (d) a cover;

wherein the quantity of filler within each bladder is in the range of 10% to 95% of the unstretched volumetric capacity of the bladder;

wherein said filler is a fluid which flows under slight pressure, shears easily and has low shape memory;

wherein the volumetric capacity of each bladder is in the range of 105% to 1000% of the space allotted to the bladder on the base;

wherein each bladder forms a supporting hammock across its top surface when a supported object rests on it;

wherein said cushioning device is capable of generally equalizing supporting hammock forces across the contact area of a supported object by conforming itself to the shape of the supported area including accommodating uneven surfaces such as protuberances and crevices;

wherein said cushioning device is adapted to contact and support an area of a human body and wherein supporting pressure exerted by said cushion on the contact surface of the body is less than that which would cause tissue damage and lead to decubitus ulcers;

wherein each bladder is sealed in order to prevent fluid communication between any two bladders, so that when required to support a cushioned object, said bladders interact with each other in a manner such that a bladder beneath a protuberance of the cushioned object is depressed and in turn exerts a generally lateral force on adjacent bladders, forcing the adjacent bladders upward to fill crevices of the cushioned object, thereby providing uniform support across the contact surface of the cushioned object;

wherein said bladders are filled with a flowable filler that includes microspheres and a quantity of lubricant sufficient to lubricate the exterior surfaces of said microspheres but insufficient to disperse the microspheres in the lubricant; and wherein said bladders are arranged in an array, said array having a width of N bladders and a length of M bladders, where both M and N are greater than 2.

2. A cushioning device as recited in claim 1, wherein each of said bladders is attached to said base by a small portion of its total surface area, permitting the bladder substantially unrestricted movement, except for its attachment point, to accommodate the shape of a supported body.

3. A cushioning device as recited in claim 1, wherein said bladders are attachable to said base by hook and loop attachment means.

4. A cushioning device as recited in claim 1, wherein said array is rectangular.

* * * * *